US011551553B2

(12) United States Patent
Bandi et al.

(10) Patent No.: US 11,551,553 B2
(45) Date of Patent: Jan. 10, 2023

(54) TRAFFIC CONTROL PREEMPTION ACCORDING TO VEHICLE ASPECTS

(71) Applicant: FORD GLOBAL TECHNOLOGIES, LLC, Dearborn, MI (US)

(72) Inventors: Krishna Bandi, Farmington Hills, MI (US); Sathyanarayana Chary Palakonda, Northville, MI (US); Swetha Shailendra, Royal Oak, MI (US); John Walpuck, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 2 days.

(21) Appl. No.: 17/237,328

(22) Filed: Apr. 22, 2021

(65) Prior Publication Data

US 2022/0343761 A1 Oct. 27, 2022

(51) Int. Cl.

*G08G 1/0969* (2006.01)
*G08G 1/087* (2006.01)
*G08G 1/01* (2006.01)

(52) U.S. Cl.

CPC ..... *G08G 1/0969* (2013.01); *G08G 1/0108* (2013.01); *G08G 1/0125* (2013.01); *G08G 1/087* (2013.01)

(58) Field of Classification Search

CPC .. G08G 1/0969; G08G 1/0108; G08G 1/0125; G08G 1/087
USPC ..... 340/995.13, 902, 906
See application file for complete search history.

(56) References Cited

U.S. PATENT DOCUMENTS 4,704,610 A * 11/1987 Smith ..... G08G 1/087 340/906
4,775,865 A * 10/1988 Smith ..... G08G 1/087 340/906
5,602,739 A * 2/1997 Haagenstad ..... G08G 1/127 701/519
5,986,575 A * 11/1999 Jones ..... G08G 1/087 340/988
6,700,504 B1 3/2004 Aslandogan et al.
6,940,422 B1 * 9/2005 Bachelder ..... G08G 1/087 340/916
6,958,707 B1 10/2005 Siegel
7,113,108 B1 * 9/2006 Bachelder ..... G08G 1/087 340/941

(Continued)

OTHER PUBLICATIONS

New Tech Gives Firetrucks a Green Light, St. Albert Today, St. Albert Gazette, Nov. 17, 2015.

*Primary Examiner* — Eric Blount
(74) *Attorney, Agent, or Firm* — Joseph M. Zane; Brooks Kushman P.C.

(57) ABSTRACT

An on-board unit (OBU) of a vehicle receives one or more data messages indicative of intersection geometry for an upcoming intersection along a roadway being traversed by the vehicle and traffic control status of a traffic control of the intersection. An outbound direction for the vehicle through the intersection is identified. A first traffic message is sent to preempt the traffic control to allow the vehicle to perform a maneuver to traverse the intersection in the outbound direction. The maneuver is indicated as complete and a second traffic message is sent to discontinue the preempt of the traffic control.

15 Claims, 8 Drawing Sheets

(56) References Cited

U.S. PATENT DOCUMENTS

| | | | | |
|---|---|---|---|---|
| 7,864,071 | B2 * | 1/2011 | Bachelder | G08G 1/095 340/906 |
| 8,294,594 | B2 * | 10/2012 | Goudy | G08G 1/096783 340/905 |
| 8,339,280 | B1 * | 12/2012 | Sikora | G08G 1/087 340/904 |
| 8,487,780 | B2 * | 7/2013 | Edwardson | G08G 1/087 340/916 |
| 9,620,011 | B2 * | 4/2017 | Cunningham | G08G 1/096 |
| 10,320,923 | B2 | 6/2019 | Moghe et al. | |
| 10,650,673 | B1 * | 5/2020 | Elsheemy | G08G 1/087 |
| 11,055,991 | B1 * | 7/2021 | Mulligan | G08G 1/095 |
| 2008/0162010 | A1 | 7/2008 | Klotz et al. | |
| 2010/0141477 | A1 * | 6/2010 | Lim | G08G 1/081 340/906 |
| 2011/0084853 | A1 * | 4/2011 | Johnson | G08G 1/087 340/909 |
| 2012/0140075 | A1 * | 6/2012 | Cunningham | G08G 1/095 348/148 |
| 2015/0243165 | A1 * | 8/2015 | Elsheemy | G08G 1/096775 340/906 |
| 2020/0365015 | A1 * | 11/2020 | Nguyen | G08G 1/0129 |
| 2022/0013008 | A1 * | 1/2022 | Katz | H04W 4/029 |

* cited by examiner

Computing Device
802

TRAFFIC CONTROL PREEMPTION ACCORDING TO VEHICLE ASPECTS

TECHNICAL FIELD

Aspects of the disclosure generally relate to preemption of traffic controls based on vehicle priority.

BACKGROUND

Vehicle-to-everything (V2X) is a type of communication that allows vehicles to communicate with various aspects of the traffic environment. This communication may include interaction with vehicles using vehicle-to-vehicle (V2V) communication and interaction with infrastructure using vehicle-to-infrastructure (V2I) communication.

Vehicles may include radio transceivers and vehicle on-board units (OBUs) to facilitate the V2X communication. Road-side units (RSUs) may provide wireless communications from roadside infrastructure to the OBUs. Such communication may be referred to as infrastructure-to-vehicle (I2V) communication. RSUs generally operate in the same frequency band as V2X, over technologies such as Cellular Vehicle-to-Everything (CV2X) and Dedicated Short Range Communications (DSRC) technologies. Some RSUs provide additional functionality, such as local Wi-Fi hotspots for pedestrians or cellular backhaul to communicate information with a central system.

SUMMARY

In one or more illustrative examples, a vehicle for performing traffic control preemption is provided. The vehicle includes a transceiver and an OBU. The OBU is programmed to receive one or more data messages indicative of intersection geometry for an upcoming intersection along a roadway being traversed by the vehicle and traffic control status of a traffic control of the intersection, identify an outbound direction for the vehicle through the intersection. The OBU is also programmed to send a first traffic message to preempt the traffic control to allow the vehicle to perform a maneuver to traverse the intersection in the outbound direction, and indicate the maneuver is complete and send a second traffic message to discontinue the preempt of the traffic control.

In one or more illustrative examples, a method for performing traffic control preemption is provided. An OBU of a vehicle receives one or more data messages indicative of intersection geometry for an upcoming intersection along a roadway being traversed by the vehicle and traffic control status of a traffic control of the intersection. An outbound direction for the vehicle through the intersection is identified. A first traffic message is sent to preempt the traffic control to allow the vehicle to perform a maneuver to traverse the intersection in the outbound direction. The maneuver is indicated as complete and a second traffic message is sent to discontinue the preempt of the traffic control.

In one or more illustrative examples, a non-transitory computer-readable medium comprising instructions for performing traffic control preemption that, when executed by a processor of an OBU of a vehicle, cause the vehicle to perform operations including to receive, by an OBU of a vehicle, one or more data messages indicative of intersection geometry for an upcoming intersection along a roadway being traversed by the vehicle and traffic control status of a traffic control of the intersection; identify an outbound direction for the vehicle through the intersection; send a first traffic message to preempt the traffic control to allow the vehicle to perform a maneuver to traverse the intersection in the outbound direction; and indicate the maneuver is complete and send a second traffic message to discontinue the preempt of the traffic control.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications.

Figure 1:
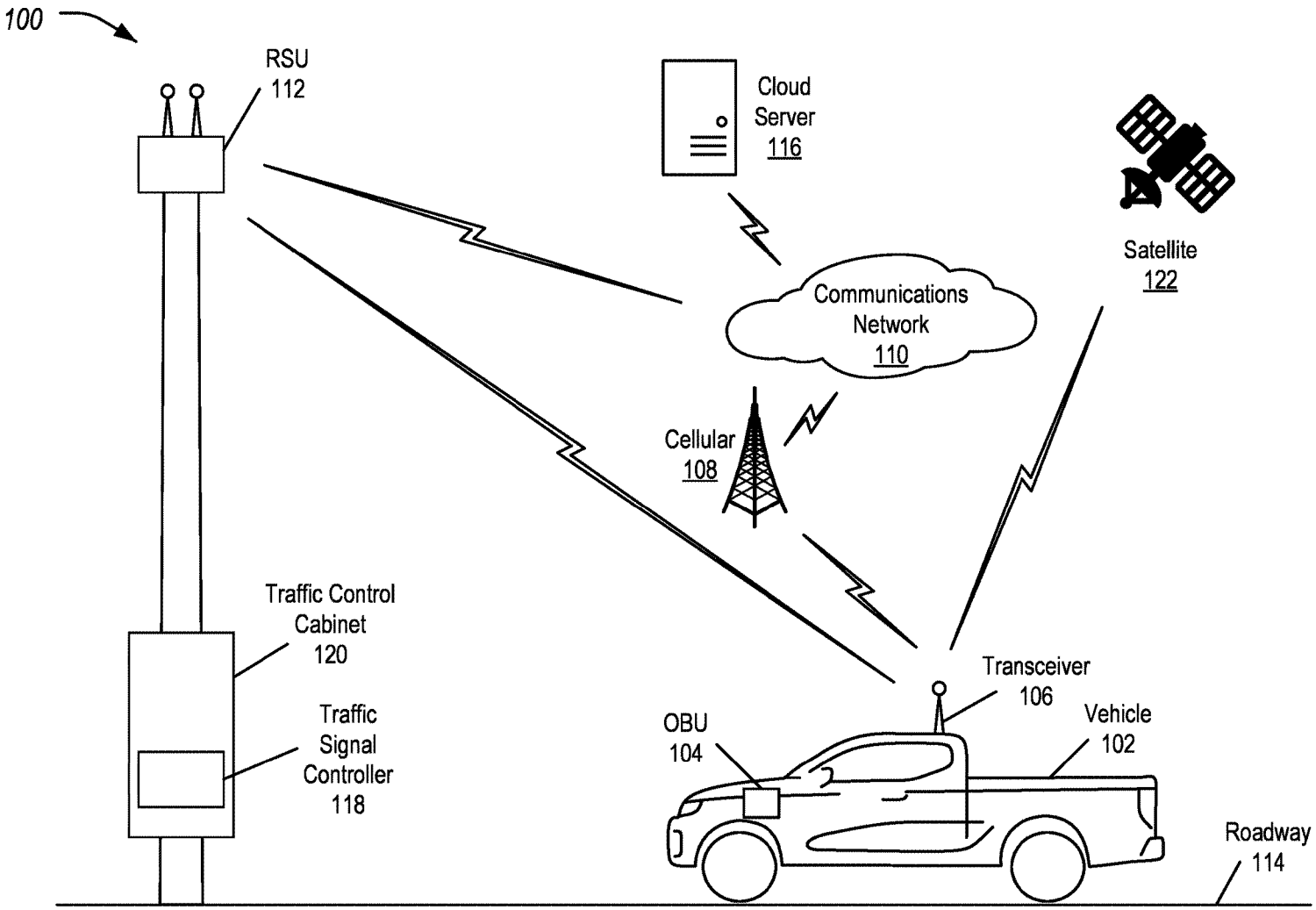
FIG. 1 illustrates an example system for the preemption of traffic control state based on priority or other vehicle aspects.

FIG. 1 illustrates an example system 100 for the preemption of traffic control state based on priority or other vehicle aspects. As shown, the system 100 includes a wireless-enabled vehicle 102 configured to travel along a roadway 114. The vehicle 102 includes an OBU 104 and a transceiver 106. The system 100 also includes traffic control installation that includes a RSU 112 and a traffic signal controller 118 located within a traffic control cabinet 120. The RSU 112 communicates with the traffic signal controller 118 over a local connection and with a cloud server 116 over a communications network 110. Using the OBU 104, the vehicle 102 communicates with the RSU 112 via the communications network 110, e.g., via cellular network 108 and/or satellite 122 communications. It should be noted that the system 100 shown in FIG. 1 is merely an example, and systems having more, fewer, and different arrangements of elements may be used. For instance, one or more of the OBU 104, RSU 112, cloud server 116, and traffic signal controller 118, may be combined into a single device. Moreover, while one vehicle 102 along one roadway 114 is shown, it is contemplated that systems 100 would include many vehicles 102 and roadways 114 to traverse.

The vehicles 102 may include various other types of passenger vehicles, such as sedans, crossover utility vehicles (CUVs), vans, sport utility vehicles (SUVs), trucks, recreational vehicles (RVs), scooters, or other mobile machines for transporting people or goods. In many cases, the vehicle 102 may be powered by an internal combustion engine. In such cases, the fuel source may be gasoline or diesel fuel. As another possibility, the vehicle 102 may be a hybrid electric vehicle (HEV) powered by both an internal combustion engine and one or more electric motors, such as a series hybrid electric vehicle (SHEV), a parallel hybrid electric vehicle (PHEV), or a parallel/series hybrid electric vehicle (PSHEV). As yet a further possibility, the vehicle 102 may be an electric vehicle (EV) powered by electric motors without an internal combustion engine. As the type and configuration of vehicles 102 may vary, the capabilities of the vehicles 102 may correspondingly vary. As some other possibilities, vehicles 102 may have different capabilities with respect to passenger capacity, towing ability and capacity, and storage volume. For title, inventory, and other purposes, the vehicle 102 may be associated with a unique identifier, such as a vehicle identification number (VIN).

The OBU 104 may be configured to provide telematics services to the vehicle 102. These services may include, as some non-limiting possibilities, navigation, turn-by-turn directions, vehicle health reports, local business search, accident reporting, and hands-free calling. The OBU 104 may be in communication with a transceiver 106. The OBU 104 may accordingly be configured to utilize the transceiver 106 to communicate with a cellular network 108 over various protocols with a communications network 110 over a network protocol (such as Uu). The OBU 104 may, additionally, be configured to communicate over a broadcast peer-to-peer protocol (such as PC5), to facilitate V2X communications with devices such as the RSU 112. It should be noted that these protocols are merely examples, and different peer-to-peer and/or cellular technologies may be used.

The communications network 110 may provide communications services, such as packet-switched network services (e.g., Internet access, voice over Internet Protocol (VoIP) communication services), to devices connected to the communications network 110. An example of a communications network 110 is a cellular telephone network. For instance, the OBU 104 may access the cellular network via connection to one or more cellular towers. To facilitate the communications over the communications network 110, the OBU 104 may be associated with unique device identifiers (e.g., mobile device numbers (MDNs), Internet protocol (IP) addresses, etc.) to identify the communications of the OBU 104 on the communications network 110 as being associated with the vehicle 102.

The RSU 112 may be a device with processing capabilities and networking capabilities, and may be designed to be placed in proximity of a roadway 114 for use in communicating with vehicles 102. In an example, the RSU 112 may include hardware configured to communicate over the broadcast peer-to-peer protocol (such as PC5), to facilitate V2X communications with the vehicles 102. The RSU 112 may also have wired or wireless backhaul capability to allow for communication with other elements of the communications network 110, such as the cloud server 116.

The RSU 112 may be further configured to communicate with a traffic signal controller 118. The traffic signal controller 118 may include one or more hardware devices configured to control operation of one or more traffic controls. In an example, the traffic signal controller 118 may be configured to control one or more traffic lights at an intersection along the roadway 114.

The traffic signal controller 118 may be mounted in a traffic control cabinet 120 for protection. The traffic control cabinet 120 may, in turn, be mounted to a utility pole, which may also be shared by the RSU 112 and/or the traffic controls themselves.

For positioning purposes, the vehicle OBU 104 may additionally include global navigation satellite system (GNSS) functionality to provide autonomous geo-spatial positioning for the vehicle 102. As some examples, the GNSS functionality may allow the vehicle 102 to determine its position using one or more satellites 122, such as global positioning system (GPS), GLONASS, Galileo, Beidou and/or others.

Figure 2:
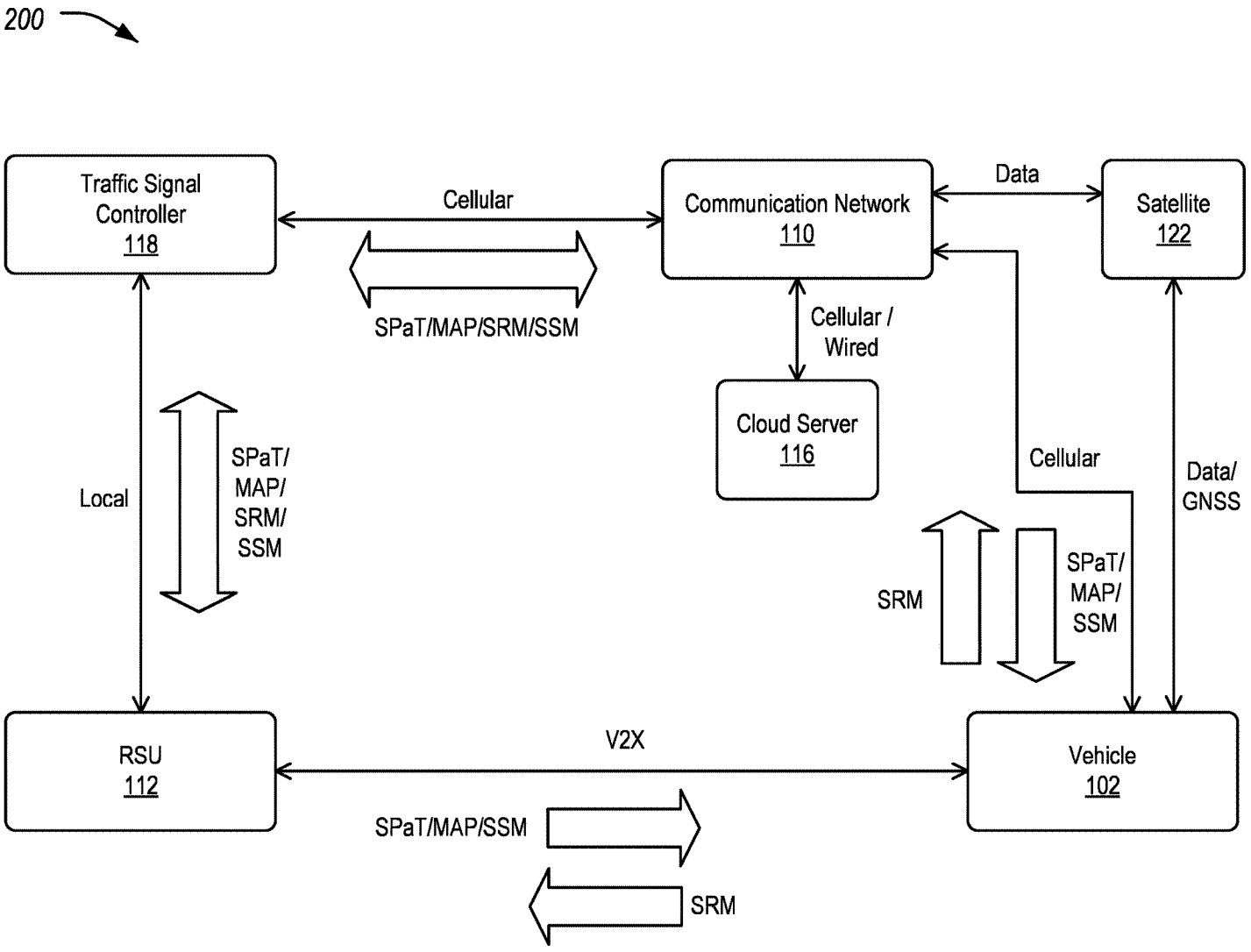
FIG. 2 illustrates an example diagram of data flow between elements of the system.

FIG. 2 illustrates an example diagram 200 of data flow between elements of the system 100. These data elements may include, as some examples, signal phase and timing information (SPaT), map data (MAP), signal request messages (SRMs), signal status messages (SSMs), BSMs, EVAs, etc.

The SPaT may be used to convey the current status of one or more signalized intersections, such as signal state of the intersection and how long this state will persist for each approach and lane that is active. The MAP message may be used to convey many types of geographic road information, and may describe the physical geometry of one or more intersections. The SRM may request preempt or priority services for selected user groups, and may be used for either a priority signal request or a preemption signal request depending on the way the request is set. The SSM may be used to relate the current status of the signal and the collection of pending or active preemption or priority requests acknowledged by the controller. The BSM may be used in a variety of applications to exchange data regarding vehicle state. The EVA messages may be used to broadcast warnings to surrounding vehicles that a priority vehicle (e.g., an incident responder of some type) is operating in the vicinity and that caution is suggested.

As shown, the RSU 112 and the traffic signal controller 118 may communicate over a local connection, such as a Wi-Fi connection or a wired connection. The RSU 112 and the traffic signal controller 118 may communicate data such as SPaT, MAP, SRM, and SSM messages.

The RSU 112 and the vehicle 102 may communicate over a V2X connection. The RSU 112 may communicate data to the vehicle 102 such as SPaT, MAP, and SSM messages. The vehicle 102 may communicate data to the RSU 112 such as SRM messages. The vehicle 102 may also receive GNSS information via satellite 122. This information may be used by the vehicle 102 to locate itself along the roadway 114.

The traffic signal controller 118 may communicate over a cellular connection with the communications network 110. The traffic signal controller 118 and the communications network 110 may communicate data such as SPaT, MAP, SRM, and SSM messages. This data may be sent to or received by the cloud server 136, and/or the vehicle 102, depending on circumstance.

The vehicle 102 may also communicate over a cellular connection with the communications network 110. The communications network 110 may communicate data to the vehicle 102 such as SPaT, MAP, and SSM messages. The vehicle 102 may communicate data to the communications network 110 such as SRM messages. This data may be sent to or received by the cloud server 136, and/or the traffic signal controller 118, depending on circumstance. The cloud server 116 may communicate over a wireless and/or wired connection to the communications network 110.

The traffic signal controller 118 may be configured to output the current movement state (e.g., signal phase and timing) for the signalized intersection. The traffic signal controller 118 may also be configured to forward the MAP, SRM, and SSM messages to the RSU 112. The RSU 112 may be configured to forward and/or broadcast the SPaT data received from the traffic signal controller 118 along with a MAP message, which describes the geometric layout of the intersection, to the vehicle 102.

Regarding the communication over the communications network 110, the SPaT and MAP data may be forwarded and/or broadcast through the communications network 110 to the vehicle 102. If so equipped, such communication may additionally and/or alternately be performed via satellite 122 communications.

Figure 3:
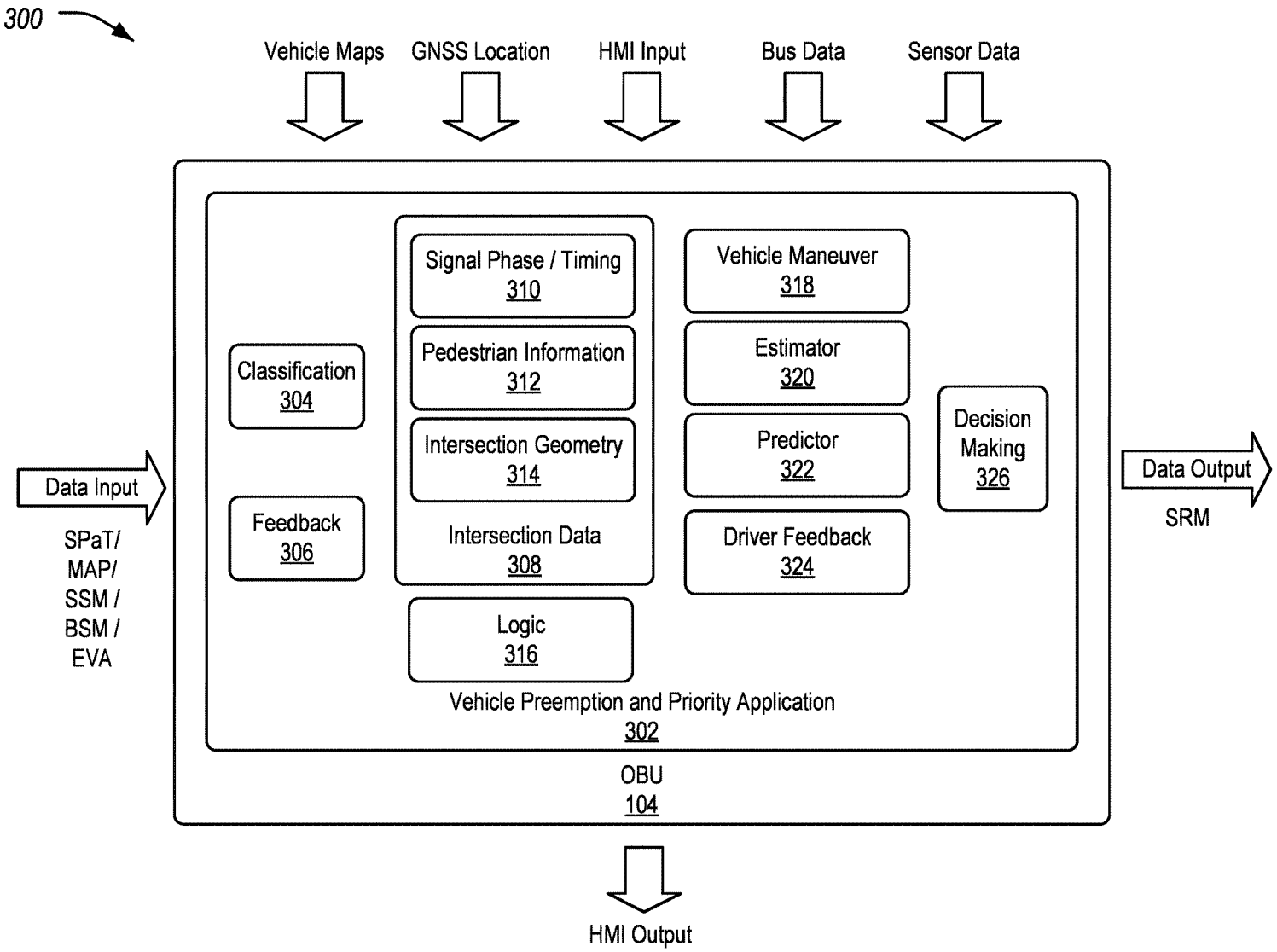
FIG. 3 illustrates an example diagram of the data flow for preemption messaging with respect to a vehicle preemption and priority application executed by the vehicle.

FIG. 3 illustrates an example diagram 300 of the data flow for preemption messaging with respect to a vehicle preemption and priority application 302 executed by the vehicle 102. The vehicle 102 may be configured to receive the SPaT, MAP, SSM, BSM, and/or EVA messages as noted above. This may be accomplished, for example, via the RSU 112, communications network 110, and/or satellite 122 communications.

The classification data 304 includes a classification of information received from various input sources, such as vehicle navigation MAPs, the vehicle bus, V2X messages (e.g., SPaT, MAP, SSM, BSM, EVA), vehicle GNSS, vehicle sensors (e.g., cameras, LIDAR, etc.). The feedback 306 includes aggregate feedback information received from the HMI of the vehicle 102, vehicle navigation MAPs, etc. The intersection data 308 includes information related to the intersection. The signal phase and timing 310 includes signal phase and timing information for the vehicle 102 (which may be based on the input from the classification data 304). The pedestrian information 312 includes the information about pedestrians (e.g., based on the classification data 304). The intersection geometry 314 includes layout information with respect to the intersection that the vehicle 102 intends to traverse (based on the classification data 304).

The estimator 320 performs a vehicle path estimation based on the classification data 304, the intersection data 308 and the current path of the vehicle 102. In an example, the estimator 320 may identify the inbound path of the vehicle 102 into an intersection using Kalman filtering. In another example, the estimator 320 may identify the inbound path of the vehicle 102 into the intersection using a machine-learning model trained using various input data mentioned above to identify the vehicle path. The estimation may be performed based on the previous path history of the vehicle 102, e.g., maneuvers of a driven path of the vehicle 102.

The predictor 322 performs vehicle 102 path prediction based on the classification data 304, intersection data 308, the estimated vehicle path determined by the estimator 320, and the intended exit lane from the intersection. The vehicle maneuver block 318 receives input from the estimator 320 and the predictor 322 to determine the maneuver of the vehicle 102. This estimation is performed inputs to estimate a future vehicle 102 maneuver.

The logic 316 receives these aforementioned data elements as input and performs the algorithm logic to produce outputs including driver feedback 324 to the vehicle 102 occupants and decision making for further broadcast of the SRM over the air.

The driver feedback 324 includes the output information outputted from the logic 316 to share with the vehicle 102 driver. The decision making 326 determines the output information outputted from the logic 316 for further broadcast of the SRM V2X message over the air.

In a first option, the vehicle preemption and priority application 302 may utilize the vehicle human-machine interface (HMI) to facilitate the sending of the SRM. The vehicle preemption and priority application 302 may, in a priority mode, display a layout of the intersection on a display of the vehicle 102. This layout may be computed by the vehicle 102 based on the geometric layout information included in the MAP message. The current trajectory of the vehicle 102 into the intersection may also be shown, based on vehicle bus data. The vehicle preemption and priority application 302 may be further configured to receive input from a driver or other vehicle 102 occupant. This input may specify an outbound direction of the vehicle through the intersection, given the in-bound direction.

In a second option, the vehicle preemption and priority application 302 may utilize various inputs to automatically determine, for the vehicle 102 according to its travel path, an intended outbound direction of the vehicle through the intersection given the in-bound direction. The in-bound-direction includes information with respect to the initial vehicle 102 state, including lane, approach, lane-connection, intersection, vehicle 102 type, request type (e.g., priority/preemption grant, cancel, etc.), vehicle 102 position (e.g., latitude, longitude, elevation), heading of the vehicle 102, speed of the vehicle 102, transmission state of the vehicle 102 (e.g., PRNDL), and/or route details of the vehicle 102 (e.g., route name, passenger occupancy, vehicle schedule etc.). The out-bound-direction includes information with respect to the ending vehicle 102 state, including lane, approach, lane-connection, intersection, vehicle 102 type, request type (e.g., priority/preemption grant, cancel, etc.), vehicle 102 position (e.g., latitude, longitude, elevation), heading of the vehicle 102, speed of the vehicle 102, transmission state of the vehicle 102 (e.g., PRNDL), and/or route details of the vehicle 102 (e.g., route name, passenger occupancy, vehicle schedule etc.).

The determination of the intended outbound direction by the vehicle preemption and priority application 302 may be informed according to various inputs. These inputs may include data from a vehicle 102 bus and/or from vehicle sensors. The data may include, as some examples, vehicle 102 position, vehicle 102 speed, vehicle 102 heading, vehicle 102 acceleration, gyroscopic data (such as latitudinal and longitudinal acceleration or deceleration), turn signal status, brake status, and steering wheel position. Other information may additionally be used, such as data from the received SPaT, MAP, BSM, and EVA messages, data from the MAP, and so on.

For instance, the outbound direction through the intersection may be identified by the vehicle 102 based on the intersection geometry defined in the MAP and a navigation route of the vehicle 102 to a destination location. Using the route, the vehicle preemption and priority application 302 generates and sends a SRM.

The RSU 112 may receive the SRM from the vehicle 102 and may forwards the SRM to the traffic signal controller 118. The traffic signal controller 118 may adjust the timing of the traffic control, and may indicate the update to the RSU 112 for further broadcast it to the vehicles 102 via a SSM. In some examples, the SRM and the SSM may be intermediated using the communications network 110 and/or satellite 122 communications.

The vehicle 102 may receive the SSM and may display a confirmation of the change in the traffic control system via the vehicle 102 HMI. The vehicle 102 may also generate a cancel signal request message responsive to the vehicle 102 exiting the intersection via the out-bound path. This accordingly allows the traffic signal controller 118 to restore normal operation of the signal phase and timing of the intersection for the intersection.

Figure 4:
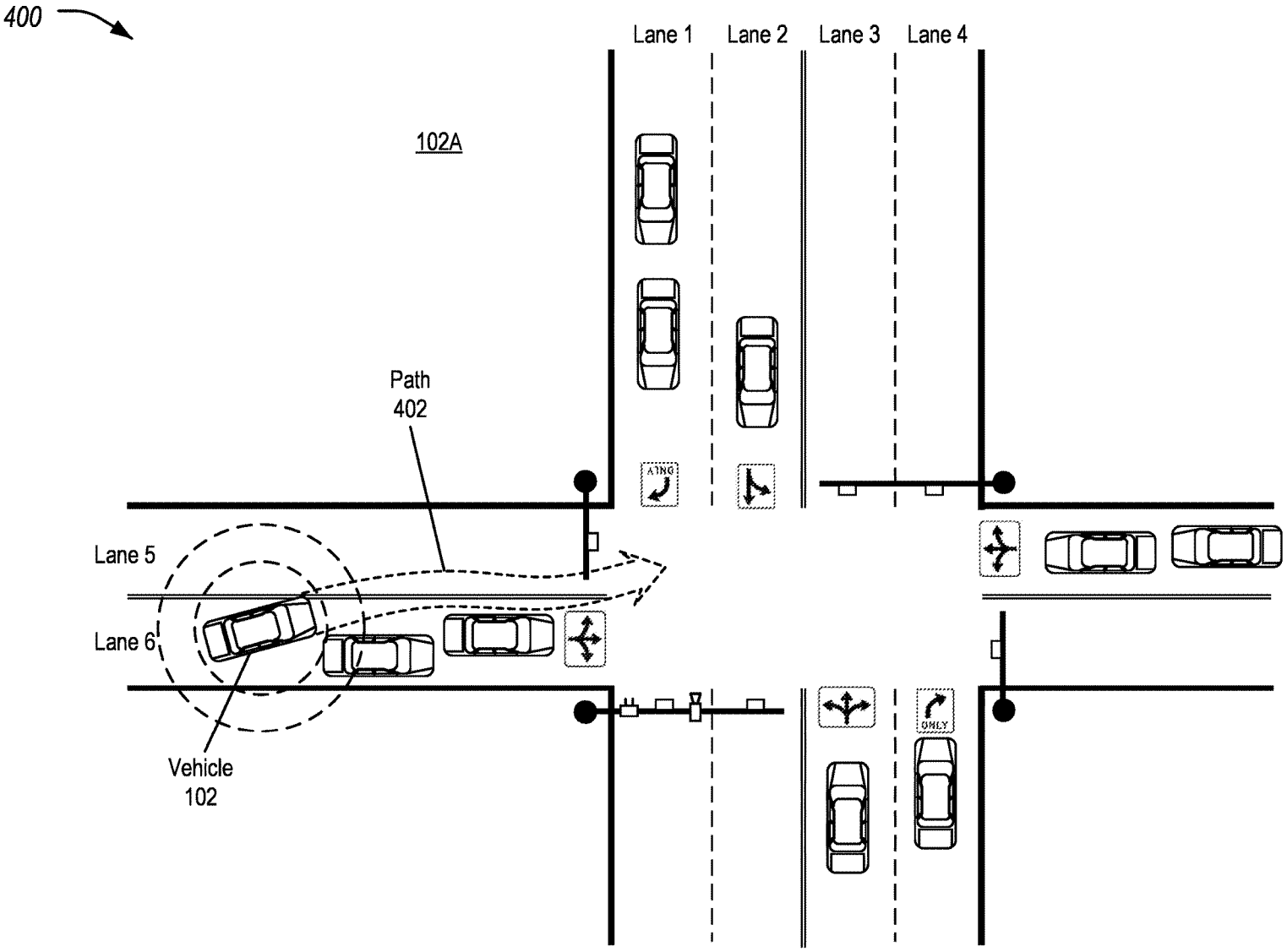
FIG. 4 illustrates an example of a vehicle preempting traffic controls at an intersection.

FIG. 4 illustrates an example 400 of a vehicle 102 preempting traffic controls at an intersection. As shown, the vehicle 102 is targeting a path 402 into the intersection based on the current location of the vehicle 102. The vehicle may determine its location using GNSS, for instance. This path 402 may be, in a first option, manually provided by the user as discussed above. In a second option, the path 402 may be suggested by the vehicle 102 according to the navigation route, also as discussed above.

Figure 5:
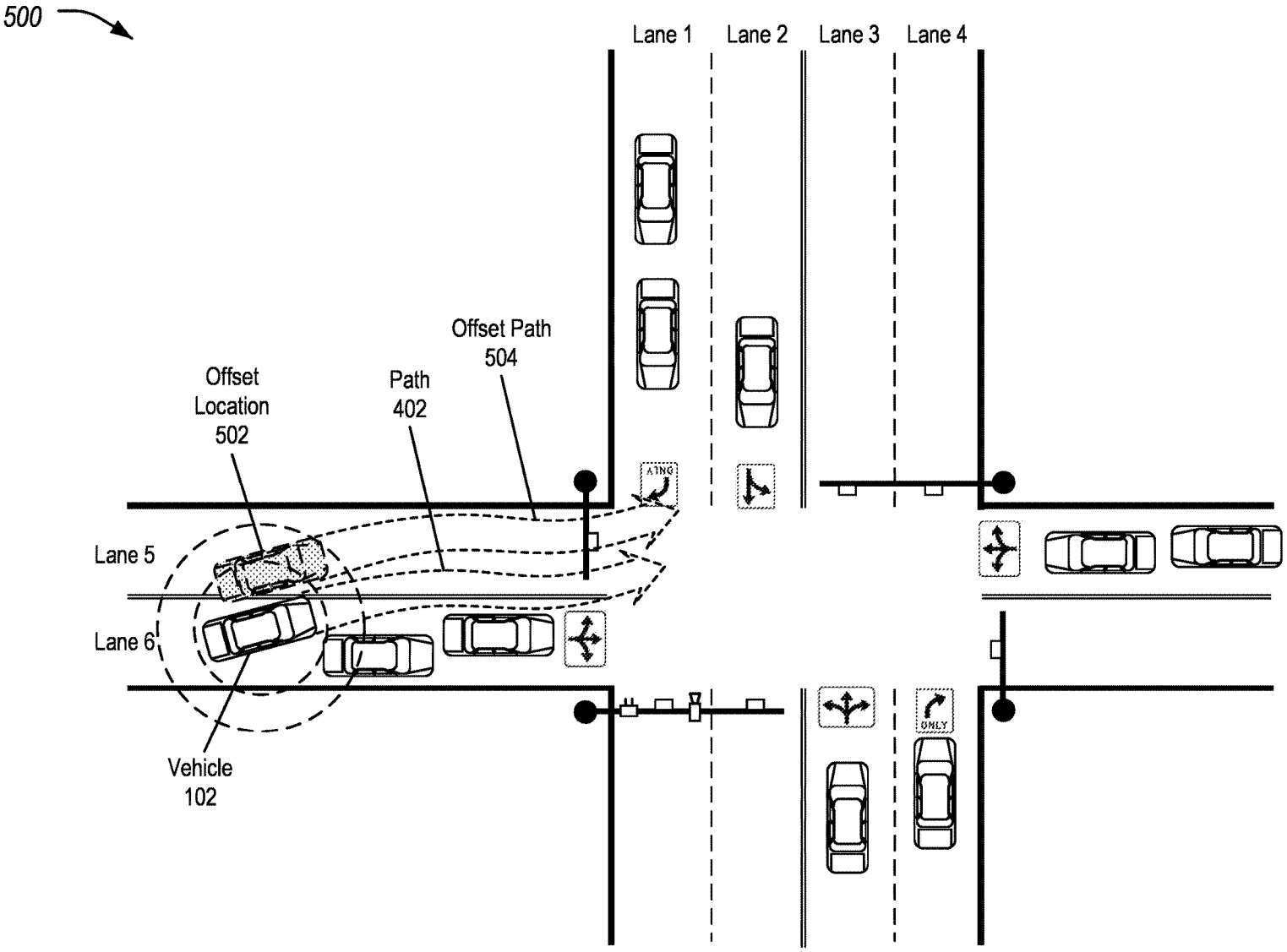
FIG. 5 illustrates an example of a vehicle preempting traffic controls at an intersection, where the measured vehicle location is offset from its actual location.

FIG. 5 illustrates an example 500 of a vehicle 102 preempting traffic controls at an intersection, where the measured vehicle 102 location is offset from its actual location. As shown, the vehicle 102 is targeting a path 402 into the intersection. However, due to GNSS measurement error, the location of the vehicle 102 is measured to be at an offset location 502 as opposed to the actual location of the vehicle 102. This further causes the path 402 to be offset to the offset path 504.

This may be corrected by the vehicle 102 in various ways. In one example, the vehicle 102 may be configured to receive location information (e.g., GNSS) from other vehicles along the roadway 114, and also to use imaging such as camera, LIDAR, RADAR sensor data of the vehicle 102. If the vehicle 102 identifies from the imaging data that the vehicle 102 is actually behind the other vehicles and not offset, then the vehicle 102 may be able to use the location information from the other vehicles 102 that to adjust the coordinates of the vehicle 102 to actually be behind and not offset. This may accordingly allow the vehicle 102 to more accurately generate the path 402.

In another example, the vehicle 102 may further utilize the geometric layout information included in the MAP message, to correct its location with respect to the intersection. For instance, the vehicle 102 may use the layout information to determine how many lanes of travel there are on the roadway 114, and which travel directions those lanes are intended to be used. In the illustration, the vehicle 102 identifies that the roadway 114 location of the vehicle 102 includes two lanes, a lane 6 in the same direction that the vehicle 102 is facing, and a lane 5 in an opposite direction from which the vehicle 102 is facing. Thus, the vehicle 102 may determine, that the vehicle 102 is actually within lane 6 and not lane 5 due to the travel direction of the vehicle 102.

Figure 6:
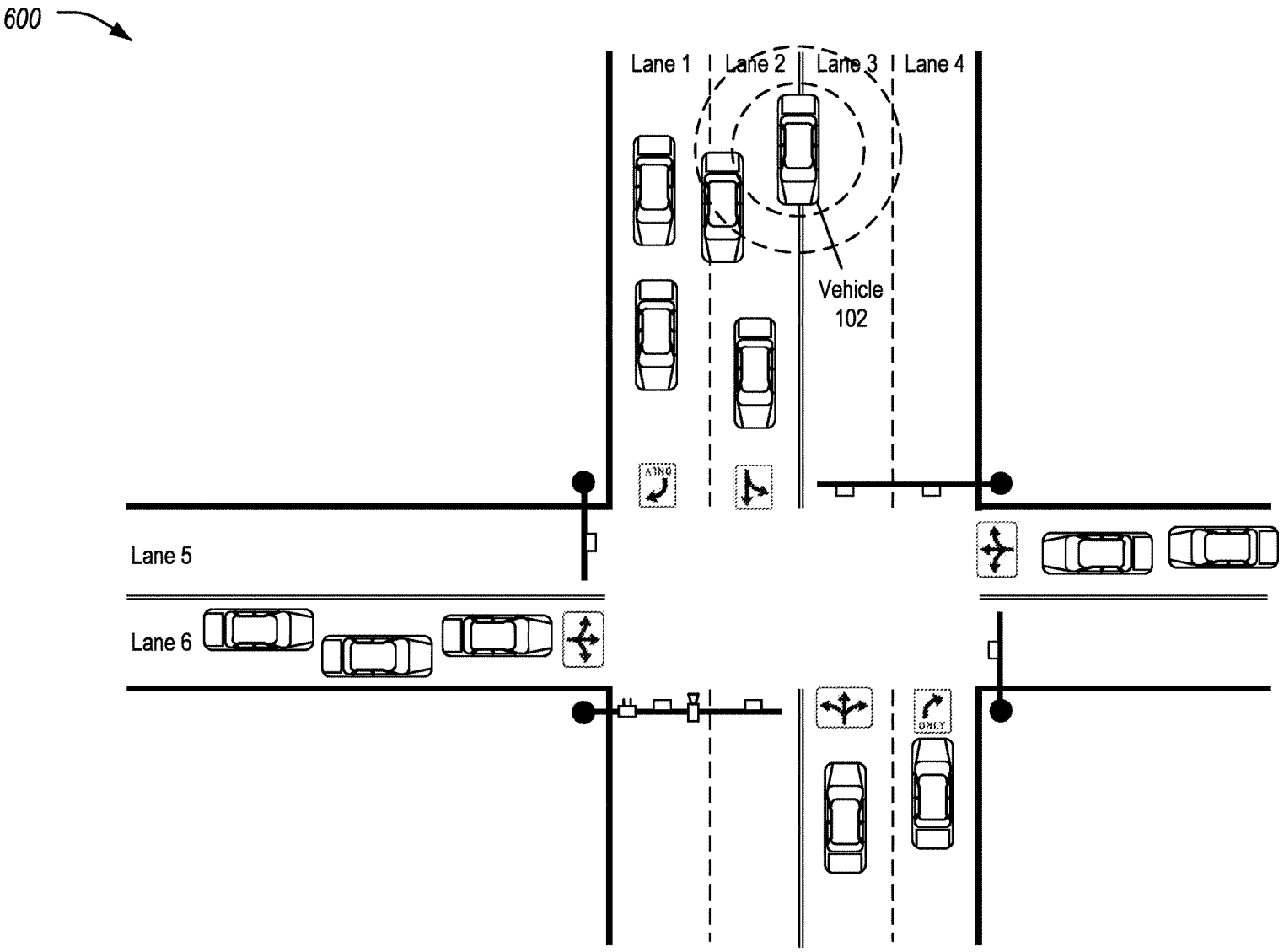
FIG. 6 illustrates an example of a vehicle approaching an intersection, where the vehicle is between lanes of the roadway.

FIG. 6 illustrates an example 600 of a vehicle 102 approaching an intersection, where the vehicle 102 is between lanes of the roadway 114. In this situation, the vehicle 102 is facing towards the intersection while partially located in lane 2 and partially located in lane 3. The MAP data for the roadway 114 indicates that there are only two southbound lanes into the intersection. However, the vehicle 102 may receive location information from the other vehicles indicating that there are already two southbound lanes of travel to the right of the vehicle 102. Thus, as opposed to the situation in FIG. 5, the vehicle 102 in FIG. 6 may infer that it is not actually traveling within one of the correct lanes.

Figure 7:
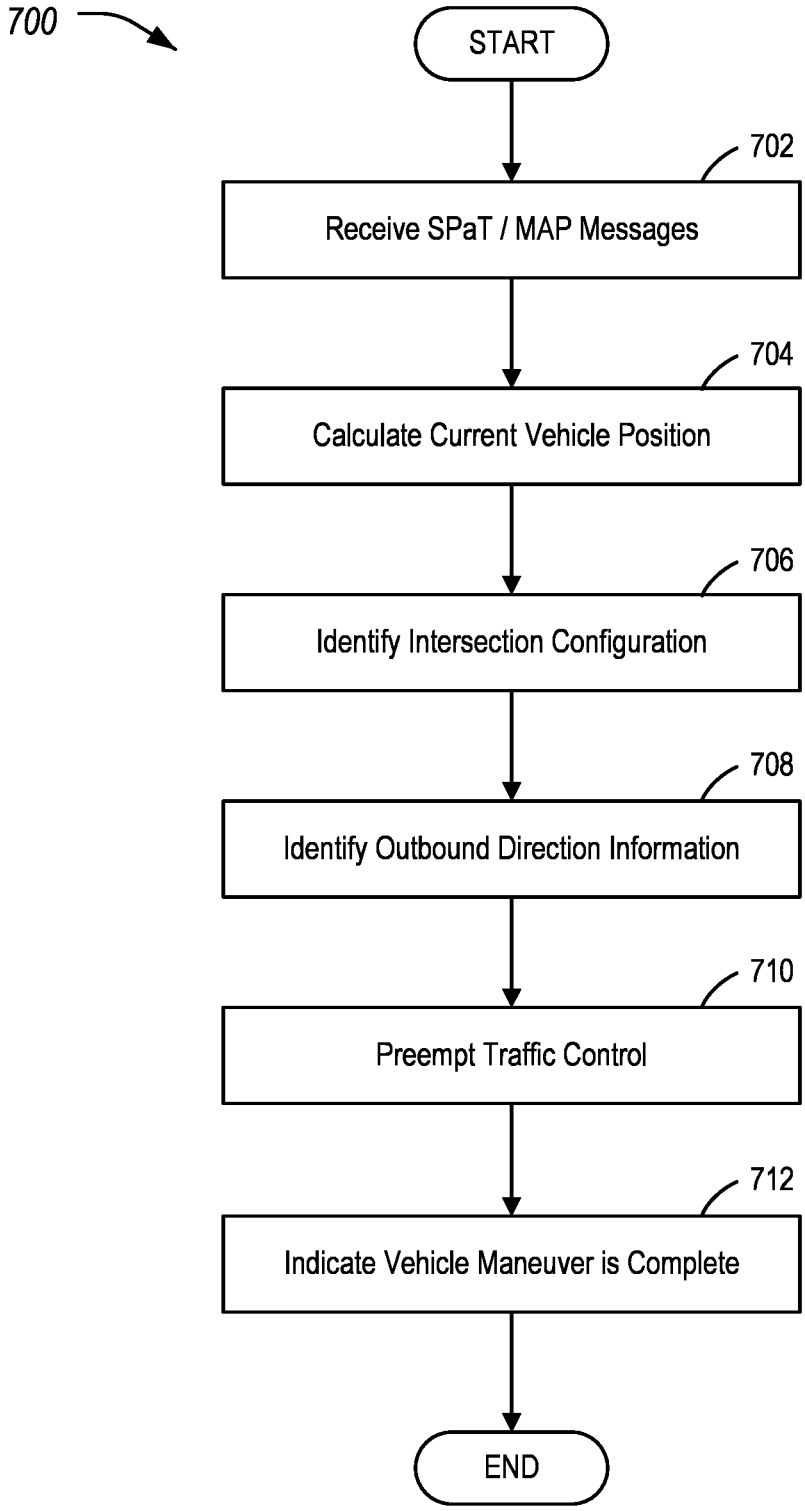
FIG. 7 illustrates an example process for the preemption of traffic control state based on priority or other vehicle aspects.

FIG. 7 illustrates an example process 700 for the preemption of traffic control state based on priority or other vehicle aspects. In an example, the process 700 may be performed by the OBU 104 of the vehicle 102 executing the vehicle preemption and priority application 302.

At operation 702, the vehicle 102 receives SPaT and MAP messages. In an example, the vehicle 102 may receive the SPaT and MAP messages from the communications network 110 from the traffic signal controller 118. In another example, the vehicle 102 may receive the SPaT and MAP messages from the RSU 112 over a V2X connection. The SPaT message may include current status of an upcoming signalized intersection, such as signal state of the intersection for each lane and for how long this state will persist. The MAP message may include information descriptive of the physical geometry of the upcoming intersection.

At operation 704, the vehicle 102 calculates its current position. In an example, the vehicle 102 may determine its location using GNSS. In another example, as discussed above, the vehicle 102 may correct its location using location information (e.g., GNSS) from other vehicles along the roadway 114, using imaging such as camera, LIDAR, RADAR sensor data of the vehicle 102, and/or using the geometric layout information included in the MAP message, to correct its location with respect to the intersection.

At operation 706, the vehicle 102 identifies an intersection configuration. In an example, the vehicle 102 may use the SPaT and MAP messages to determine the intersection configuration. This configuration may indicate the travel lanes and geometry of the intersection, as well as which lanes are signaled for passage.

At operation 708, the vehicle 102 identifies outbound direction information with respect to the intersection. In an example, using the intersection configuration, the vehicle 102 displays the configuration of the intersection on a screen of the vehicle 102. The current trajectory of the vehicle 102 into the intersection may also be shown, based on vehicle bus data. The vehicle preemption and priority application 302 may be further configured to receive input from a driver or other vehicle 102 occupant. This input may specify an outbound direction of the vehicle through the intersection, given the in-bound direction.

In another example, the vehicle preemption and priority application 302 may utilize various inputs to automatically determine, for the vehicle 102 according to its travel path, an intended outbound direction of the vehicle through the intersection given the in-bound direction. The determination of the intended outbound direction by the vehicle preemption and priority application 302 may be informed according to various inputs. These inputs may include data from a vehicle 102 bus and/or from vehicle sensors. The data may include, as some examples, vehicle 102 position, vehicle 102 speed, vehicle 102 heading, vehicle 102 acceleration, gyroscopic data (such as latitudinal and longitudinal acceleration or deceleration), turn signal status, brake status, and steering wheel position. Other information may additionally be used, such as data from the received SPaT, MAP, BSM, and EVA messages, data from the MAP, and so on. The path 402 and outbound direction through the intersection may be identified by the vehicle 102 based on the intersection geometry defined in the MAP and a navigation route of the vehicle 102 to a destination location.

At operation 710, the vehicle 102 sends a SRM to preempt the traffic controls for the intersection. In an example, the vehicle 102 may send the SRM via the communications network 110 to the traffic signal controller 118. In another example, the vehicle 102 may send the SRM to the RSU 112 over the V2X connection, which in turn communicates the SRM to the traffic signal controller 118. The SRM may indicate, to the traffic signal controller 118, a preemption of the traffic control timing to allow the vehicle 102 to traverse the intersection. The vehicle 102 may then traverse the intersection along the path 402. The vehicle 102 may also receive a SSM from the traffic signal controller 118 and may display a confirmation of the change in the traffic control via the vehicle 102 HMI.

At operation 712, the vehicle 102 indicates that the vehicle 102 maneuver is complete. For instance, the vehicle 102 may identify, based on the intersection configuration, that the vehicle 102 has proceeded through the controlled area of the intersection and has left out one of the legs of the intersection. As such, the vehicle 102 no longer has a use for preempting the timing of the traffic control. The vehicle 102 may also generate a cancel signal request message responsive to the vehicle 102 exiting the intersection via the out-bound path. This accordingly allows the traffic signal controller 118 to restore normal operation of the signal phase and timing of the intersection for the intersection. After operation 712, the process 700 ends.

Figure 8:
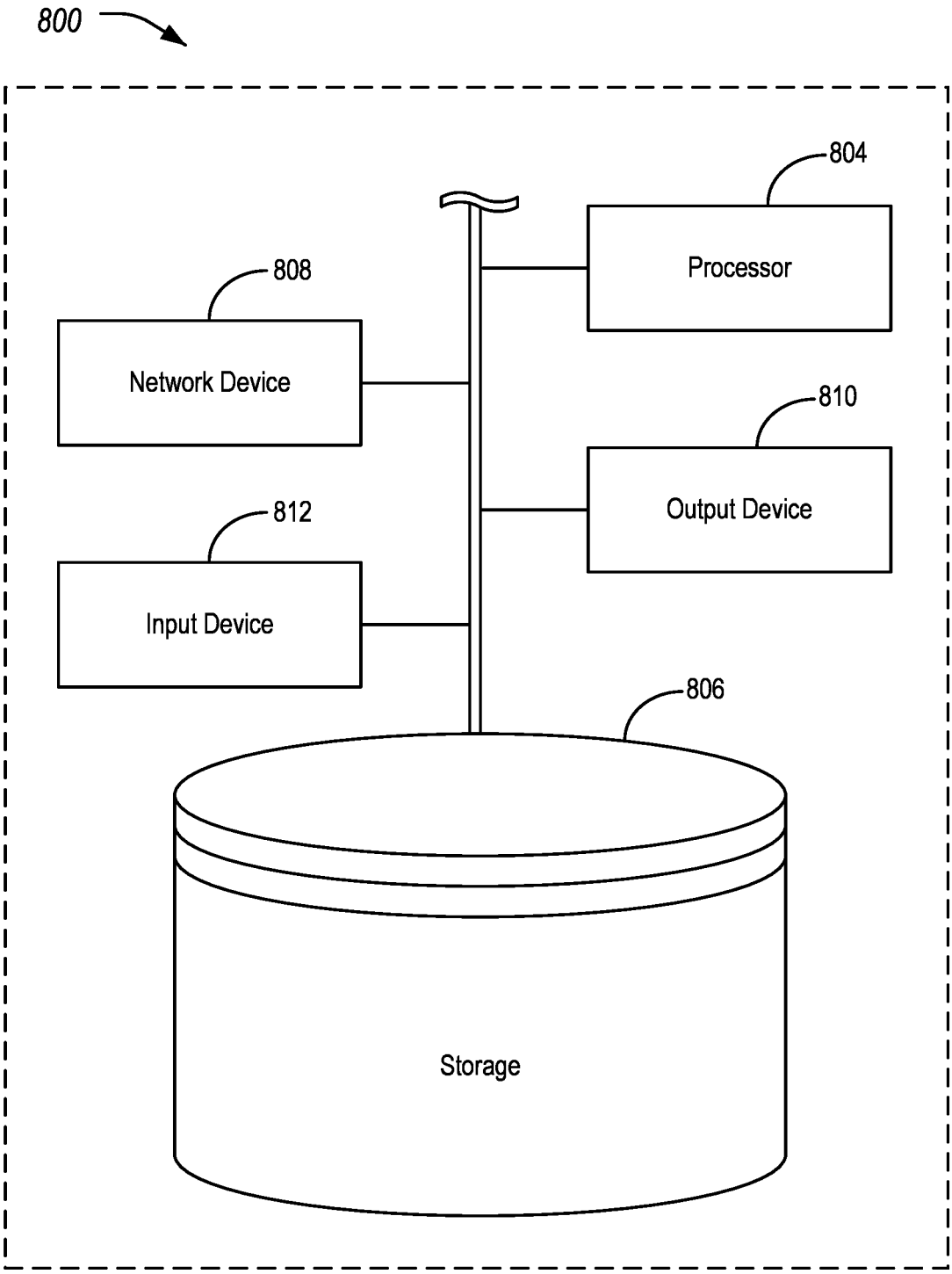
FIG. 8 illustrates an example of a computing device for use in the preemption of traffic control state based on priority or other vehicle aspects.

FIG. 8 illustrates an example 800 of a computing device 802 for use in the preemption of traffic control state based on priority or other vehicle aspects. Referring to FIG. 8, and with reference to FIGS. 1-7, the OBU 104, RSU 112, cloud server 116, and traffic signal controller 118 may be examples of such computing devices 802. As shown, the computing device 802 may include a processor 804 that is operatively connected to a storage 806, a network device 808, an output device 810, and an input device 812. It should be noted that this is merely an example, and computing devices 802 with more, fewer, or different components may be used.

The processor 804 may include one or more integrated circuits that implement the functionality of a central processing unit (CPU) and/or graphics processing unit (GPU). In some examples, the processors 804 are a system on a chip (SoC) that integrates the functionality of the CPU and GPU. The SoC may optionally include other components such as, for example, the storage 806 and the network device 808 into a single integrated device. In other examples, the CPU and GPU are connected to each other via a peripheral connection device such as Peripheral Component Interconnect (PCI) express or another suitable peripheral data connection. In one example, the CPU is a commercially available central processing device that implements an instruction set such as one of the x86, ARM, Power, or Microprocessor without Interlocked Pipeline Stages (MIPS) instruction set families.

Regardless of the specifics, during operation the processor 804 executes stored program instructions that are retrieved from the storage 806. The stored program instructions, accordingly, include software that controls the operation of the processors 804 to perform the operations described herein. The storage 806 may include both non-volatile memory and volatile memory devices. The non-volatile memory includes solid-state memories, such as Not AND (NAND) flash memory, magnetic and optical storage media, or any other suitable data storage device that retains data when the system is deactivated or loses electrical power. The volatile memory includes static and dynamic random-access memory (RAM) that stores program instructions and data during operation of the system 100.

The GPU may include hardware and software for display of at least two-dimensional (2D) and optionally three-dimensional (3D) graphics to the output device 810. The output device 810 may include a graphical or visual display device, such as an electronic display screen, projector, printer, or any other suitable device that reproduces a graphical display. As another example, the output device 810 may include an audio device, such as a loudspeaker or headphone. As yet a further example, the output device 810 may include a tactile device, such as a mechanically raiseable device that may, in an example, be configured to display braille or another physical output that may be touched to provide information to a user.

The input device 812 may include any of various devices that enable the computing device 802 to receive control input from users. Examples of suitable input devices that receive human interface inputs may include keyboards, mice, trackballs, touchscreens, voice input devices, graphics tablets, and the like.

The network devices 808 may each include any of various devices that enable the OBU 104, RSU 112, and/or traffic signal controller 118, to send and/or receive data from external devices over networks (such as the communications network 110). Examples of suitable network devices 808 include an Ethernet interface, a Wi-Fi transceiver, a cellular transceiver, or a BLUETOOTH or BLUETOOTH Low Energy (BLE) transceiver, or other network adapter or peripheral interconnection device that receives data from another computer or external data storage device, which can be useful for receiving large sets of data in an efficient manner.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A vehicle for performing traffic control preemption, comprising:

a transceiver; and an on-board unit (OBU), programmed to:

receive one or more data messages indicative of intersection geometry for an upcoming intersection along a roadway being traversed by the vehicle and traffic control status of a traffic control of the intersection, identify an outbound direction for the vehicle through the intersection, send a first traffic message to preempt the traffic control to allow the vehicle to perform a maneuver to traverse the intersection in the outbound direction, indicate the maneuver is complete and send a second traffic message to discontinue the preempt of the traffic control, use the intersection geometry to determine lanes of travel of the roadway and travel directions of the lanes, receive location information from other vehicles along the roadway, receive imaging data of the other vehicles from onboard vehicle sensors of the vehicle, and one or more of:

identify from the imaging data that the vehicle is behind the other vehicles, and utilize the location information from the other vehicles to adjust a current location of the vehicle to be behind the other vehicles, or determine based on the imaging data and the location information from the other vehicles that the vehicle is not behind the other vehicles and maintain the current location of the vehicle without adjustment of the current location as being behind the other vehicles.

2. The vehicle of claim 1, wherein the vehicle further includes a human-machine interface (HMI), and the OBU is further programmed to:

display a configuration of the intersection on the HMI, receive input from a vehicle occupant to the HMI indicative of the outbound direction.

3. The vehicle of claim 1, wherein the OBU is further programmed to determine the outbound direction according to input data from a vehicle bus and/or vehicle sensors, and according to a navigation route of the vehicle to a destination location.

4. The vehicle of claim 3, wherein the input data includes one or more of: vehicle position, vehicle speed, vehicle heading, vehicle acceleration, gyroscopic data indicative of latitudinal and longitudinal acceleration or deceleration, turn signal status, brake status, or steering wheel position.

5. The vehicle of claim 1, wherein the one or more data messages include signal phase and timing information (SPaT) and map data (MAP).

6. The vehicle of claim 1, wherein the first and second traffic messages are signal request messages (SRMs).

7. A method for performing traffic control preemption, comprising:

receiving, by an OBU of a vehicle, one or more data messages indicative of intersection geometry for an upcoming intersection along a roadway being traversed by the vehicle and traffic control status of a traffic control of the intersection;

identifying an outbound direction for the vehicle through the intersection;

sending a first traffic message to preempt the traffic control to allow the vehicle to perform a maneuver to traverse the intersection in the outbound direction; and indicating the maneuver is complete and send a second traffic message to discontinue the preempt of the traffic control;

using the intersection geometry to determine lanes of travel of the roadway and travel directions of the lanes;

receiving location information from other vehicles along the roadway;

receiving imaging data of the other vehicles from onboard vehicle sensors of the vehicle;

one or more of:

identifying from the imaging data that the vehicle is behind the other vehicles and utilizing the location information from the other vehicles to adjust a current location of the vehicle to be behind the other vehicles, or determining based on the imaging data and the location information from the other vehicles that the vehicle is not behind the other vehicles and maintaining the current location of the vehicle without adjustment of the current location as being behind the other vehicles.

8. The method of claim 7, further comprising:

displaying a configuration of the intersection on an HMI of the vehicle; and receiving input from a vehicle occupant to the HMI indicative of the outbound direction.

9. The method of claim 7, further comprising determining the outbound direction according to input data from a vehicle bus and/or vehicle sensors and according to a navigation route of the vehicle to a destination location.

10. The method of claim 9, wherein the input data includes one or more of: vehicle position, vehicle speed, vehicle heading, vehicle acceleration, gyroscopic data indicative of latitudinal and longitudinal acceleration or deceleration, turn signal status, brake status, or steering wheel position.

11. The method of claim 7, further comprising:

estimating an inbound direction for the vehicle through the intersection using input data including one or more of vehicle position, vehicle speed, vehicle heading, vehicle acceleration, gyroscopic data indicative of latitudinal and longitudinal acceleration or deceleration, turn signal status, brake status, or steering wheel position; and predicting the outbound direction for the vehicle through the intersection using the estimated inbound direction, the input data, and the intersection geometry for the upcoming intersection.

12. A non-transitory computer-readable medium comprising instructions for performing traffic control preemption that, when executed by a processor of an OBU of a vehicle, cause the vehicle to perform operations including to:

receive, by an OBU of a vehicle, one or more data messages indicative of intersection geometry for an upcoming intersection along a roadway being traversed by the vehicle and traffic control status of a traffic control of the intersection;

identify an outbound direction for the vehicle through the intersection;

send a first traffic message to preempt the traffic control to allow the vehicle to perform a maneuver to traverse the intersection in the outbound direction; and indicate the maneuver is complete and send a second traffic message to discontinue the preempt of the traffic control;

receive location information from other vehicles along the roadway;

receive imaging data of the other vehicles from onboard vehicle sensors of the vehicle; and one or more of:

identify from the imaging data that the vehicle is behind the other vehicles and utilize the location information from the other vehicles to adjust a current location of the vehicle to be behind the other vehicles, or determine based on the imaging data and the location information from the other vehicles that the vehicle is not behind the other vehicles and maintain a current location of the vehicle without adjustment of the current location as being behind the other vehicles.

13. The medium of claim 12, further comprising instructions that, when executed by the processor of the OBU of the vehicle, cause the vehicle to perform operations including to:

display a configuration of the intersection on an HMI of the vehicle; and receive input from a vehicle occupant to the HMI indicative of the outbound direction.

14. The medium of claim 12, further comprising instructions that, when executed by the processor of the OBU of the vehicle, cause the vehicle to perform operations including to determine the outbound direction according to input data from a vehicle bus and/or vehicle sensors and according to a navigation route of the vehicle to a destination location.

15. The medium of claim 14, wherein the input data includes one or more of: vehicle position, vehicle speed, vehicle heading, vehicle acceleration, gyroscopic data indicative of latitudinal and longitudinal acceleration or deceleration, turn signal status, brake status, or steering wheel position.

* * * * *